US006960375B2

(12) United States Patent
Giblin et al.

(10) Patent No.: US 6,960,375 B2
(45) Date of Patent: Nov. 1, 2005

(54) BOTTLE CONTAINING RECYCLED POLYMERS

(75) Inventors: Edward John Giblin, Hopatcong, NJ (US); John Michael Paulovich, Hewitt, NJ (US)

(73) Assignee: Unilever Home & Personal Care USA, Division of Conopco, Inc., Greenwich, CT (US)

( * ) Notice: Subject to any disclaimer, the term of this patent is extended or adjusted under 35 U.S.C. 154(b) by 23 days.

(21) Appl. No.: 10/445,464

(22) Filed: May 27, 2003

(65) Prior Publication Data

US 2004/0241360 A1 Dec. 2, 2004

(51) Int. Cl.[7] ..... B65D 1/00
(52) U.S. Cl. ..... 428/35.7; 428/903.3
(58) Field of Search ..... 428/35.7, 903.3, 428/35.2, 35.9, 212, 213, 215, 515, 516; 220/62.22; 222/109, 183; 525/240; 526/348.1

(56) References Cited

U.S. PATENT DOCUMENTS

| | | | | |
|---|---|---|---|---|
| 192,886 | A | | 7/1877 | Warner |
| 195,697 | A | | 10/1877 | Brawley |
| 272,318 | A | | 2/1883 | Prentice |
| 286,379 | A | | 10/1883 | Bogia |
| 300,005 | A | | 6/1884 | Patterson |
| 305,407 | A | | 9/1884 | Sweet |
| 306,410 | A | | 10/1884 | Ludlow |
| 311,864 | A | | 2/1885 | Adler |
| 312,964 | A | | 2/1885 | Brown |
| 321,624 | A | | 7/1885 | McPherson |
| 326,052 | A | | 9/1885 | Newbury |
| 332,747 | A | | 12/1885 | Payne |
| 348,612 | A | | 9/1886 | Blake |
| 351,347 | A | | 10/1886 | Tremain |
| 353,541 | A | | 11/1886 | Cowper |
| 3,385,461 | A | | 5/1968 | Mallin ..... 215/1 |
| 4,668,834 | A | | 5/1987 | Rim et al. ..... 585/12 |
| 4,747,992 | A | | 5/1988 | Sypula et al. ..... 264/130 |
| 4,846,359 | A | | 7/1989 | Baird et al. |
| 4,874,734 | A | | 10/1989 | Kioka et al. ..... 502/104 |
| 5,021,109 | A | | 6/1991 | Petropoulos et al. ..... 156/137 |
| 5,128,091 | A | | 7/1992 | Agur et al. ..... 264/812 |
| 5,206,075 | A | | 4/1993 | Hodgson, Jr. ..... 428/516 |
| 5,232,107 | A | | 8/1993 | Krall et al. |
| 5,358,792 | A | | 10/1994 | Mehta et al. ..... 428/516 |
| 5,376,439 | A | | 12/1994 | Hodgson et al. ..... 428/220 |
| 5,382,631 | A | | 1/1995 | Stehling et al. ..... 525/240 |
| 5,393,599 | A | | 2/1995 | Quantrille et al. ..... 428/284 |
| 5,397,613 | A | | 3/1995 | Georgelos ..... 428/36.7 |
| 5,397,640 | A | | 3/1995 | Georgelos et al. ..... 428/349 |
| 5,419,795 | A | | 5/1995 | Wood et al. ..... 156/184 |
| 5,420,220 | A | | 5/1995 | Cheruvu et al. ..... 526/348.1 |
| 5,422,172 | A | | 6/1995 | Wu ..... 428/230 |
| 5,552,198 | A | * | 9/1996 | Hiltner et al. ..... 428/35.7 |
| 5,783,637 | A | * | 7/1998 | Herman et al. ..... 525/240 |
| 5,989,725 | A | * | 11/1999 | Bullard et al. ..... 428/516 |
| 6,159,918 | A | | 12/2000 | Bae-lee et al. ..... 510/293 |
| 6,223,945 | B1 | * | 5/2001 | Giblin et al. ..... 222/109 |
| 6,464,106 | B1 | | 10/2002 | Giblin et al. |
| 2002/0039630 | A1 | | 4/2002 | Rousselet et al. |

FOREIGN PATENT DOCUMENTS

| | | | | |
|---|---|---|---|---|
| JP | 2000/190438 | | 12/1998 | |
| JP | 2000246852 | A * | 9/2000 | ..... B32B/27/32 |
| WO | 94/25350 | | 11/1994 | |
| WO | 97/26315 | | 7/1997 | |

* cited by examiner

*Primary Examiner*—Sandra Nolan Rayford
(74) *Attorney, Agent, or Firm*—Milton L. Honig

(57) ABSTRACT

The invention provides a bottle having at least three layers in which the outer and inner layers contain a metallocene polyethylene polymer and the middle layer comprises virgin high density polyethylene, regrind and post-consumer recycled resin, with the bottle having at least 10% light transmittance in the visible spectrum.

17 Claims, 2 Drawing Sheets

BOTTLE CONTAINING RECYCLED POLYMERS

FIELD OF THE INVENTION

The present invention relates to transparent or translucent bottles comprising at least three layers and wherein one layer contains metallocene high density polyethylene.

BACKGROUND OF THE INVENTION

One popular form of laundry detergent is the heavy duty laundry liquid. Its popularity is due in part to the convenience of the product form, in particular the ability to apply the detergent readily to soiled areas of the clothes. The popularity of laundry liquids has created a need for more convenient containers for dispensing these products.

Laundry liquid detergents have traditionally been sold in opaque bottles. These bottles have been improved over time to incorporate measuring cups serving as closures, and fitments incorporating drainage mechanisms and pouring spouts. Bottles that are less opaque than those traditionally used have been placed on the market recently. While these bottles are less opaque than those traditionally used, they remain to be cloudy.

The use of bottles having greater clarity can be aesthetically appealing to consumers as the consumer can see the consistency of product, suspended particles if they are present, separation of phases if a dual phase composition is present or other aspects or properties of the laundry liquid product. Transparent bottles may also be appealing to consumers during use as it enables the consumer to ascertain easily how much product remains.

It is of increasing interest, therefore, to develop a transparent bottle that is suitable for holding liquid products such as heavy duty laundry liquid detergent.

ADDITIONAL INFORMATION

Efforts have been disclosed for making bottles or containers that are more clear or transparent. Many of these efforts have dealt with other concerns when using a clear bottle such as the protection of the bottle and its contents from UV radiation which may be harmful to the bottle and its contents.

For instance, U.S. Pat. No. 6,159,918 a clear bottle is disclosed comprising UV absorber to protect the contents. WO 97/26315 (to Colgate) discloses transparent containers.

Other art such as Stehling et al. U.S. Pat. No. 5,382,631 is directed to interpolymer blends which may comprise linear polyethylenes prepared by catalyst systems of the metallocene type. It is said that the blends of the invention can be used to advantage in all forming operations, such as blow molding, injection molding and roto molding and that molded articles include single and multilayered constructions in the form of bottles, tanks, etc.

Hodgson et al. U.S. Pat. No. 5,376,439 discloses a polymer composition comprising a blend of a very low density ethylene polymer and a low to medium density ethylene polymer.

Metallocene catalysts may be used. The invention also provides for films prepared from the blend which may have a single layer construction or a laminated ABA construction wherein the A layer comprises the blend of the invention and the B or core layer comprises a different olefin layer such as high density polyethylene.

Metha et al. U.S. Pat. No. 5,358,792 is directed to heat sealable compositions comprising a) a low melting polymer comprising an ethylene based copolymer having a density of from 0.88 g/cm3 to about 0.915 g/cm3 and b) a propylene based polymer. The ethylene based copolymer is produced with a metallocene catalyst.

A Hodgson U.S. Pat. No. 5,206,075 is directed to a laminar polyolefin film material having a base film layer which is a blend of an olefin polymer and a very low density copolymer of ethylene. The VLDPEs which may be used as the copolymer component of the base or sealing layers of the film of the invention can be polymerized with the use of metallocene catalyst systems. The films are said to be very useful for high speed packaging operations.

Wu U.S. Pat. No. 5,422,172 discloses an elastic laminated sheet made of a nonwoven fibrous web and an elastomeric film. The elastomeric film may be made using metallocene catalysts.

Cheruvu et al. U.S. Pat. No. 5,420,220 discloses a film of a linear low density copolymer of ethylene (LLDPE) said to have excellent processability, optical properties and impact strength. The resins are said to exhibit narrower molecular weight distribution.

The following patents relate to metallocenes: Wood et al. U.S. Pat. No. 5,419,795, Georgelos et al. U.S. Pat. No. 5,397,640, Georgelos U.S. Pat. No. 5,397,613, Quantrille et al. U.S. Pat. No. 5,393,599, Agur et al. U.S. Pat. No. 5,128,091, Petropoulos et al. U.S. Pat. No. 5,021,109, Kioka et al. U.S. Pat. No. 4,874,734, Sypula et al. U.S. Pat. No. 4,747,992 and Rim et al. U.S. Pat. No. 4,668,834.

Other containers are illustrated in Rogler et al. U.S. Pat. No. Des. 353,541, Ring U.S. Pat. No. Des. 351,347, Ring U.S. Pat. No. Des. 348,612, Darret al. U.S. Pat. No. Des. 332,747, Jacobs U.S. Pat. No. Des. 300,005, Visser U.S. Pat. No. Des. 272,318, Platte U.S. Pat. No. Des. 265,797, Kaplan U.S. Pat. No. Des. 192,886, Price U.S. Pat. No. Des. 195,697, Lyons U.S. Pat. No. Des. 286,379, Gonda U.S. Pat. No. Des. 305,407, Chambers U.S. Pat. No. Des. 306,410, Davis U.S. Pat. No. Des. 311,864, Carmine U.S. Pat. No. Des. 312,964, Fiore et al. U.S. Pat. No. Des. 321,624, Beechuk et al. U.S. Pat. No. Des. 326,052, Baird et al. U.S. Pat. No. 4,846,359, Krall et al. U.S. Pat. No. 5,232,107, Mallin U.S. Pat. No. 3,385,461 and WO 94/25350.

While clear or transparent containers may be known in the general art of packaging, none of the additional information above describes a multi-layer bottle that has a polyethylene middle layer and is clear or transparent.

SUMMARY OF THE INVENTION

In a first aspect, the present invention is directed to a bottle fabricated from at least three layers, including a middle layer, an outer layer and an inner layer wherein the outer and inner layers are a metallocene polyethylene polymer, and wherein the bottle has at least 10% transmittance of light in the visible spectrum.

In a second aspect, the present invention is direct to a bottle comprising a downwardly extending body fabricated from at least three layers, including an external and internal layer wherein the external and internal layers are a metallocene polyethylene polymer and wherein the bottle further comprises a finish having an annular mouth, the body extending axially downwardly along a vertical axis from said finish to a base; the body including a shoulder extending outwardly and downwardly below the finish, the bottle having at least 10% transmittance of light in the visible spectrum.

For purposes of this invention, the term "inner" layer or "internal" layer means the most inner layer of the multilayer bottle wall. The term "outer" layer or "external" layer means the most outer layer of the multilayer bottle wall. The term "middle" layer means any layer that is between the inner or outer layer of the bottle wall.

The present invention is directed to transparent bottles for dispensing liquid household products such as liquid detergents and liquid fabric softeners. The bottle is comprised of a multilayer body in which one layer includes polyethylene and another layer includes polyethylene made with a metallocene catalyst. The bottles of the invention have greater clarity than a traditional bottle made of polyethylene yet continue to have properties suitable for use with liquids such as laundry liquids. Preferably the metallocene polyethylene layer is the outside and inner layers of a trilayer structure.

The metallocene layer may comprise 100% of the bottles outside and inside layers. In further embodiments, the outside and/or inside layer(s) may be a blend comprising 10–99 wt % metallocene plastomer. Preferably the other blend component is high density polyethyene. The plastomer blends readily with HDPE.

The metallocene plastomer resin used in the bottle of the invention has a density of from about 0.91 g/cm$^3$ to about 0.95, g/cm$^3$ and preferably, from about 0.92 g/cm$^3$ to about 0.95 g/cm$^3$, and most preferably, from about 0.93 g/cm$^3$ to about 0.94 g/cm$^3$ and includes all ranges subsumed therein.

In further embodiments, the multilayer bottle body is combined with other features such as a downwardly extending body having axially extending side panels fabricated from the multiple polymer layers. The container is preferably in the form of a bottle having a drainback fitment. Advantageously, the bottle is more clear than a traditional laundry liquid bottle, but at the same time is functional as a heavy duty liquid detergent or other dispenser. With use of the metallocene resins in accordance with the invention, the bottle may be significantly more clear or transparent without adversely affecting other properties.

Metallocene polymers are described in Stehling et al. U.S. Pat. No. 5,382,631 and Mehta et al. U.S. Pat. No. 5,358,792, the disclosures of which are incorporated by reference herein.

In preferred embodiments, the multilayer resin structure is combined with other features to form a more clear or transparent bottle suitable for use as a heavy duty liquid detergent container. Preferably, the bottle is also suitable for other uses, such as containing liquid fabric softeners, light duty liquid detergents, eg hand dishwashing detergents), automatic dishwashing detergents such as gels, chemicals, foods, etc.

Pouring of product from the container is believed to be facilitated by an off-centered neck. The bottles of the various embodiments of the invention may also include an optional handle or other integral gripping feature.

The multilayer bottle of the invention is advantageously fabricated with certain resins. In addition to the outer and/or inner metallocene polyethylene layer, it is preferably that a middle layer employs at least 25% recycled resin.

For a more complete understanding of the above and other features and advantages of the invention, reference should be made to the following detailed description of preferred embodiments and to the accompanying drawings.

DETAILED DESCRIPTION OF THE INVENTION

Figure 1:
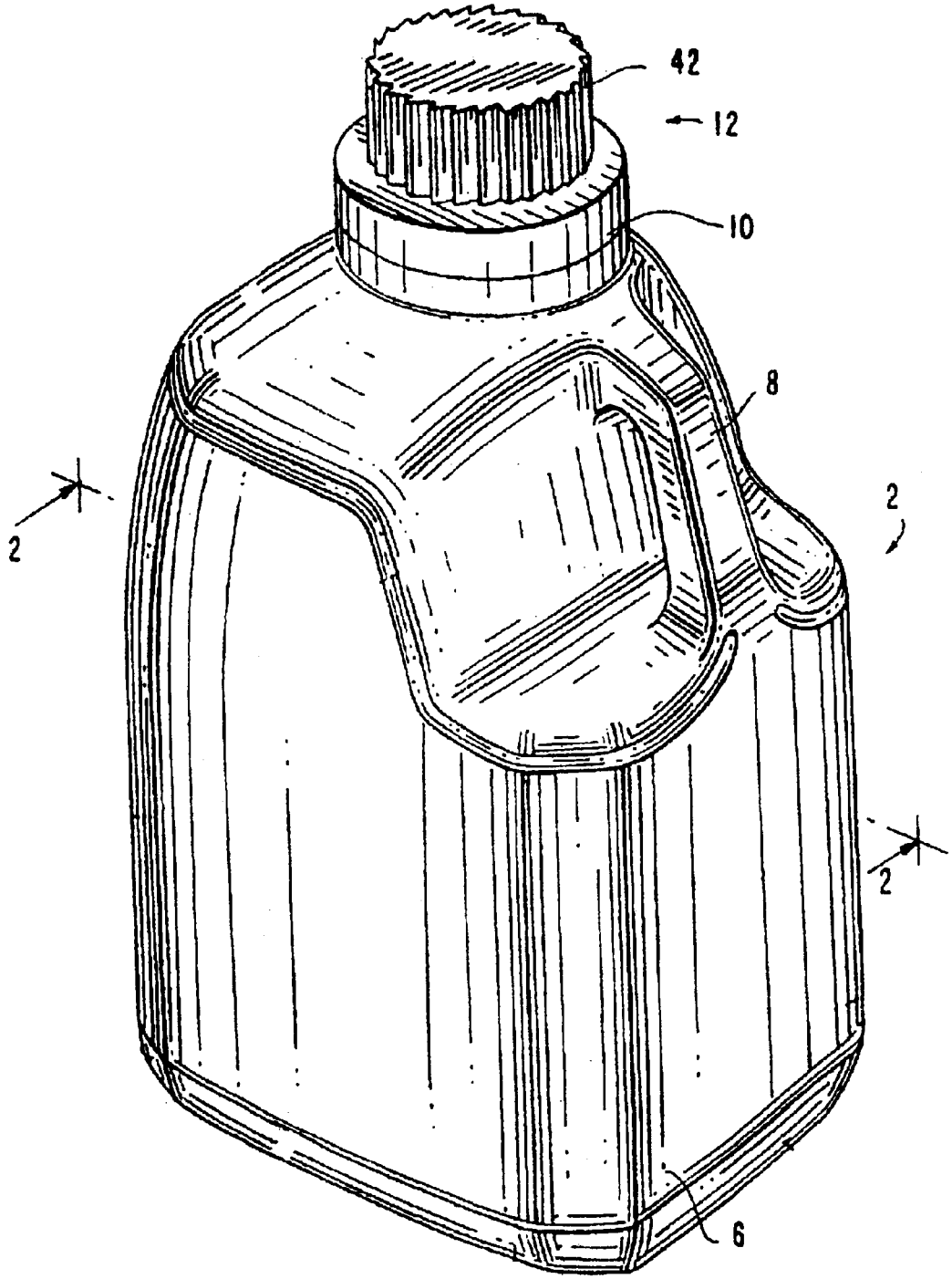
FIG. 1 is a perspective view of a container of the invention with the closure fastened.
Figure 2:
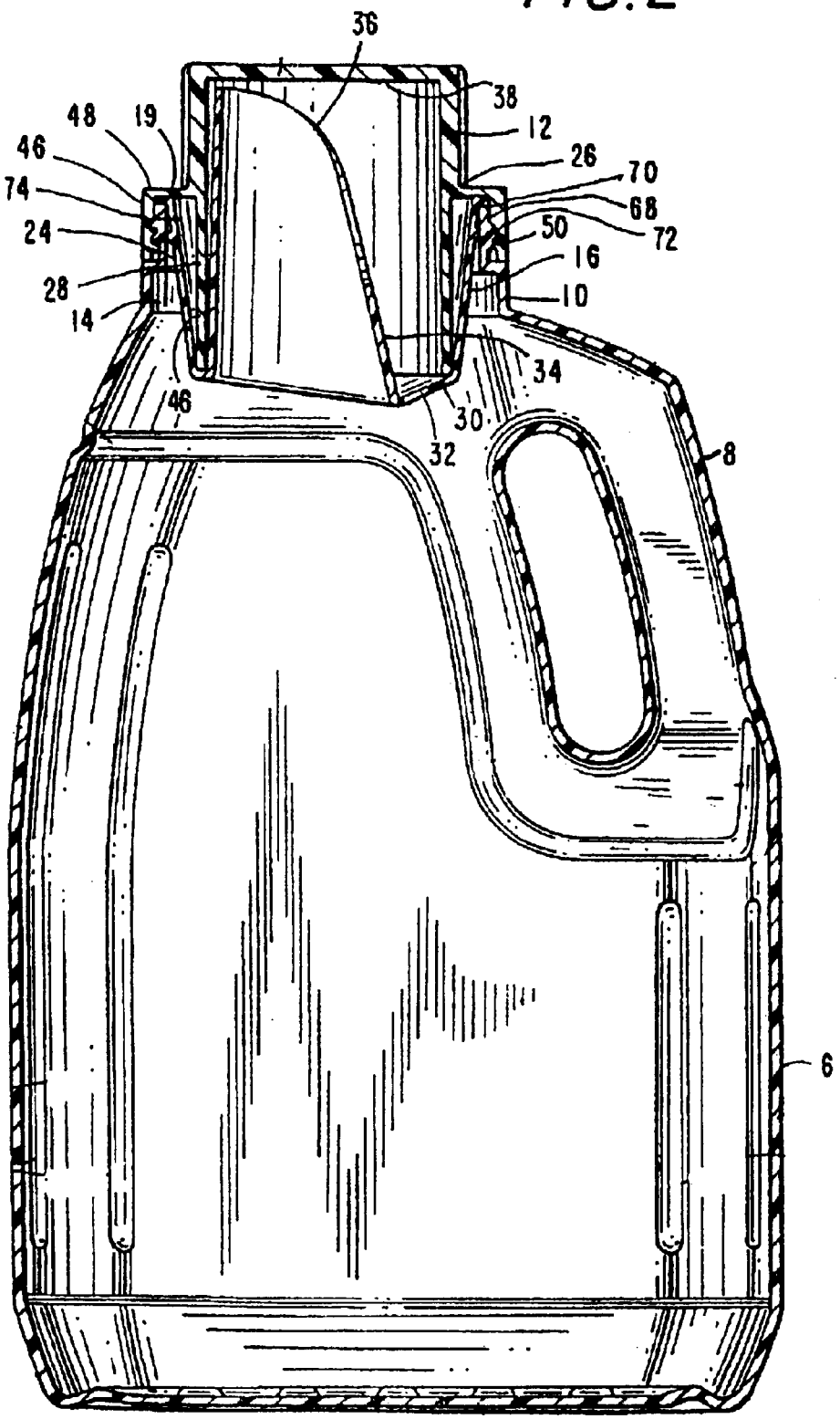
FIG. 2 is a section along the lines 2—2 of FIG. 1, except that the container additionally includes corner grooves.

Referring now particularly to the drawings, a bottle of the invention utilizing an outer and/or inner metallocene polyethylene plastomer layer will be described with respect to a specific embodiment. In FIGS. 1 and 2 there is shown a container 2 including a bottle 6 having an integral handle 8 and a neck 10. The container 2 also includes a drainback fitment 14. Fastened to the top of the container 2, as viewed in FIG. 1, there is a closure or cap 12. All of the foregoing components are preferably molded from a resilient flexible plastic material. The materials may be selected so that the plastic from which the drainback fitment 14 is molded is softer than the materials from which the bottle 6 and closure 12 are formed. Alternatively, the drainback fitment may be made of a material of comparable hardness to that of which the closure is made, e.g., polypropylene or HDPE.

The drainback fitment has an outer, frustoconical wall portion 16 which gradually tapers downwardly and inwardly and is received within the neck 10 of the bottle 6. The wall portion 16 terminates at its upper end in an annular rim 19. Rim 19 is generally flat.

The surface of the rim turns downwardly and inwardly to form the outer wall 24 of a circumferential well 26 surrounding a generally frustoconical, eccentrically positioned (off-center) spout 36, the lower periphery of which forms the inner wall 28 of the circumferential well 26. Between the outer wall 24 and inner wall 28 of the circumferential well 26 there is a sloping floor 30.

The outer surface of wall 16 optionally includes a retaining ring which is spaced from and generally concentric with rim 19. Wall 16 may include a product exit aperture (or drain port) located above and spaced from the product drainage aperture 32. The basic features of the fitment, bottle finish and closure are as shown in FIG. 9 of Davidson et al. U.S. Pat. No. 5,108,009, the disclosure of which patent is hereby incorporated by reference herein. An appropriate product drainage aperture is illustrated in more detail in FIG. 3 of Davidson et al.

The spout may include projections to keep the fitments separated during stacking. Such projections may also serve to prevent rotation of the spouts during stacking when combined with lugs (not shown) depending from the bottom of the fitment and situated so that they block radial movement of the stacking projections on the next lower fitment when the fitments are stacked.

Notch 32 and longitudinal slot 34 provide a path for residual liquid remaining on the spout 36 or closure 12 to drain back into the bottle 6 either directly or via the downwardly sloping floor 30 of the circumferential well 26 under the force of gravity when the container 2 is in an upright position.

Fitment 14 is secured to bottle finish 68 by a friction fit. Bottle finish 68 includes an annular mouth 70, and a locking ridge 72. The finish includes threads 74. The fitment is inserted into the bottle by forcing it through the opening at the bottle mouth and pushing it until annular rim 19 of the fitment is situated upon or above locking ridge 72. If rim 19 is above locking ridge 72, preferably it is immediately above. In this position, the distal end of the annular rim will be adjacent to bottle mouth 70. Optionally, a retaining ring of the fitment helps to retain the fitment in position by abutting the lower aspects of locking ridge 72.

If desired, the spout 36 may be provided with an anti-drip lip. Also, it may be desirable to provide the spout with a V-shaped pouring angle for improved control of pouring of the product.

The drainback fitment 14 may be formed from a thermoplastic such as high density polyethylene. Or it may be made of a polyethylene which is a product of a 50:50 blend of a high density resin and a low density resin. The high density resin can be U.S.I. LS 506 or a similar resin. The low density resin can be U.S.I. LS 208 or the like. Instead of a mix of resins, a low density polyethylene such U.S.I. 241 or even a harder material such as polypropylene may be used to form the fitment. Other plastic resins having chemical and physical properties similar to the aforementioned resins can be used in fabricating the drainback fitment 14.

Preferably, the container of the invention provides the spout and drainback area in the form of the above described fitment, separate from the body of the bottle. In the described preferred embodiment, the fitment snaps into the container finish so that a friction fit is obtained between the outer wall of the fitment and a locking ridge on the inside of the container finish. A fitment may also be provided in other ways, eg it may be applied by spin welding, or by hot melt adhesive or by the EMABOND system. An internally threaded finish may be combined with an externally threaded closure.

The EMABOND system employs a thermoplastic gasket impregnated with metal particles. When the gasket is in position (between a sealing area ridge of the fitment and inside bottle neck ledge), a sealing unit with an electromagnetic force presses down on the fitment and heats up the metal particles, thereby melting the plastic gasket, and the compression welds the two components together with a leak-proof seal.

Although the fitment would normally be a separate piece, it may also be formed integral to the bottle. A threaded collar could then be spin welded onto the exterior of the bottle to mate with the threads of the closure.

It is also contemplated that some of the embodiments may be in the form of refill bottles which contain a plain screw cap and no spout but which are capable of receiving a transferable spout and self draining closure.

The closure 12 has a closed end 38 at its top which is merged at its circumference with a downwardly extending inner circumferential wall 46 having a surface onto which there are integrally molded gripping teeth 42 biased to present greater friction to the hand when the closure 12 is rotated counterclockwise to loosen it than when it is rotated clockwise for tightening. Alternatively, other gripping means, such as vertical ribbings may be employed.

Complimentary fastener means in the form of threads are provided on the closure 12 and neck 10 of the bottle 6 at their juncture. The closure 12 has internal threads 50 which mate with external threads 74 on the finish 68 of the bottle.

As the closure 12 is threaded onto the neck 10 of the bottle 6, the liner, if present, engages the mouth 70 of the bottle 6 thereby sealing the bottle to prevent leakage of the contents from the container. When the liner is omitted, the top of the channel seals against the mouth 70 of the bottle. The presence of the fitment rim below the top of the finish permits the closure (or the liner of the closure) to form a seal at one point at the top of the finish. If the fitment rim extended over the top of the fitment there would be two areas for liquid product to escape through the seal, above and below the rim of the fitment.

As is apparent from FIG. 2, except for the spout, fitment 14 is wholly contained within the bottle 6. The entire outer wall 16 is situated below the mouth 70 of this bottle.

Although the fitment herein has been described as having a single product exit aperture, a plurality of apertures may be utilized.

The closure may be formed of a harder material than that used in the drainback fitment 14. In the preferred embodiment of the invention, the plastic material from which the closure 12 is molded is a homopolymer polypropylene such as that sold by Phillips Petroleum Company under the designation Phillips HLV 120-01 or may be polypropylene copolymer.

The bottle 6 also may be formed of a material that is harder than the material employed in the drainback fitment 14. Alternately, the fitment may be formed of a harder material, as where the fitment is fabricated from polypropylene.

In accordance with certain embodiments of the invention, the bottle 6 is made from multiple polymeric layers, which include an outer and/or inner layer including metallocene polyethylene.

The outer and/or inner layer(s) may be a blend such as metal locene polyethylene and high density polyethylene (HDPE) such as one at about 25%/75% by wt %.

Polyethylene polymers with which the metallocene polyethylene polymers may be blended include: Paxon AC 45-004 (0.945 density); Chevron 9503 (0.946 density); Chevron 9346 (0.9455 density) (pipe resin); Phillips D252 (Marlex) LLDPE (25% LLDPE/75% HDPE) (density 0.923; melt index 0.25)—Resin is called "low density, linear polyethylene on data sheet.

The outer, middle or inner layer(s) may be pigmented or non-pigmented. It is further preferred that the middle layer be a high density polyethylene. This will assist in making the container more resistant to top load pressure. Examples of materials which may be used include Paxon AU55-003, a medium molecular weight distribution high density polyethylene copolymer available from Paxon Polymer Company of Baton Rouge, La., and Paxon AC45-004, a high density polyethylene copolymer available from Paxon Polymer Company. Either of the above may advantageously be used in conjunction with a percentage, say 25% of a recycled resin, i.e., a post-consumer recycled resin (PCR) such as a high density polyethylene bottle scrap.

Preferably, the bottle comprises panels having a multilayer structure including i) an outer layer comprising a metallocene polyethylene material, ii) a middle layer comprising a minimum of 25% recycled resin, in-process regrind plus some virgin resin, and iii) an inner layer comprising a metallocene polyethylene material. It is especially preferred that the features of the individual or combined embodiments of the invention be present in a bottle fabricated from a multilayer structure including i) a virgin inner layer including metallocene polyethylene, ii) a middle layer comprising a minimum of 25% recycled resin, and iii) a virgin resin outer layer including metallocene polyethylene material. Recycled resin is preferably HDPE homopolymer from used milk or water bottles and possibly used detergent bottles of about the same color.

Ranges of thicknesses preferred in a multilayer material would be 10–20% outer, 10–80% middle and 10–20% inner. A useful arrangement (percentage thickness) of layers is expected to be 10% outer layer, 80% middle layer and 10% inner layer. Additional preferred resins useful in blends for the outer layer include Chevron polyethylene 9402 (20%) and Chevron polyethylene 9503 (20%).

Additional preferred resins for the middle layer (70%): Chevron virgin 9402 PCR polyethylene homopolymer (employs recycled PE).

Additional preferred resins useful for blends for the inner layer include Chevron 9301 polyethylene (10%).

While trilayer structures (5–30% outer/60–90% middle/5–30% inner layers, particularly 10–20% outer/70–80% middle/10–20% inner layers) will generally be preferred, quadlayer or other multilayer structures may also be used. While it will generally be preferred that inner and/or outer layer(s) be virgin (i.e. not recycled resin), the inner and/or outer layer(s) may include some recycled resin. Where the inner and/or outer layer(s) includes recycled resin, one candidate will be blends containing LLDPE from recycled pallet stretch film. Other good candidates include LLDPE and LLDPE/HDPE blends, metallocene polyethylene (MPE) (e.g., Exxon's Exact) and MPE/HDPE blends. It will generally be preferred that middle layer include at least 25% PCR. A foamed HDPE middle layer may also be used.

The use of a neck or finish which is displaced from the center is believed to facilitate pouring of product from the container. To determine whether a neck finish is off-center for the purposes of the invention, one measures the distance from one side to the other of the bottle's length, measured at the point of maximum length, i.e., the maximum horizontal dimension when the container is standing on its base. Then one determines the center point of that distance from one side to the other. The next step is to ascertain where the center point of the container finish, ie the center of the bottle mouth, falls along the line drawn from one side of the container to the other at its longest length. The percentage displacement is calculated by subtracting the distance in position between the center point of the finish and the center of the container length at its widest point and dividing that figure by the length of the bottle at its widest point.

An example of the percentage displacement calculation is as follows. If the container has its maximum length at the bottom, and the length of the bottom is 16 cm, and a vertical line drawn through the center of the finish intersects the length line at 10.6 cm, the calculation is as follows: (10.6 minus 8 (the midpoint of the length)), divided by 16. The result is 16.25%. For the purposes of the invention, a neck finish is considered off center if the displacement percentage is greater than 3%. Preferred displacements are from 3% through 20%. Especially preferred is if the percentage is from 5%–20%.

Bottles made in accordance with the present invention have at least 10% transmittance of light through a 1 mm thick sample at a wavelength 410–800 nanometers wherein the composition is substantially free of dyes. For purposes of the invention, as long as one wavelength in the visible light range has greater than 10% transmittance, it is considered to be transparent. Preferably, bottles in accordance with the present invention will have at least 15%, and more preferably 20%, and most preferably 25% transmittance of light through a 1 mm thick sample at a wavelength of 410–800 nanometers. For purposes of the invention, as long as one wavelength in the visible light spectrum has transmittance greater than a designated amount x, it is considered to have a transmittance of at least that amount x in the visible light spectrum. This transmittance can be easily measured by placing a sample of known thickness of the material to be tested (1 mm in the case of the samples measured herein) in the light beam path of a UV-VIS Spectrophotometer such as the Hewlett-Packard 8451A Diode Array Spectrophotometer.

Sample 1 and Comparative Sample A are bottle samples having a wall thickness of 1 mm. Each sample has a trilayer configuration. The composition of Sample 1 and Comparative Sample A is shown in the Table below.

| | Sample 1 | Comparative Sample A |
|---|---|---|
| Outer layer | metallocene polyethylene[1] | virgin HDPE[3] |
| Middle layer | 25% PCR[2] | 25% PCR[2] |
| | 50% regrind[4] (of all) | 50% regrind[4] |
| | 25% virgin HDPE[3] | 25% virgin HDPE[3] |
| Inner layer | metallocene polyethylene[1] | virgin HDPE[3] |

[1]Metallocene polyethylene is Finacene BM359 SG by Atofina.
[2]Grade 1 PCR homopolymer by KR Plastics.
[3]Paxon AM55-003
[4]Regrind is a blend of the other ingredients of the respective sample.

In each of Sample 1 and Comparative Sample A, the outer and inner layers have a thickness of 10% of the total wall thickness. The middle layer has a thickness of 80% of the total wall thickness.

The transmittance of light in the visible range (approximately 410–800 nanometers) was measured for both Sample 1 and Comparative Sample A.

| | % Transmittance/mm | |
|---|---|---|
| Wavelength (nm) | Sample 1 | Comparative Sample A |
| 400 | 1.45 | 0.15 |
| 500 | 5.78 | 0.67 |
| 600 | 11.65 | 1.43 |
| 700 | 18.50 | 2.45 |
| 800 | 24.19 | 3.35 |
| 820 | 25.40 | 3.6 |

It was surprisingly found that the trilayer bottle of Sample 1 having inner and outer layers comprising metallocene polyethylene was significantly clearer than the trilayer bottle of Comparative Sample A having inner and outer layers comprising virgin HDPE.

Alternatively, transparency of the composition may be measured as having an absorbency in the visible light wavelength (about 410 to 800 nm) of less than 15A/cm.

The following examples are intended to further illustrate the invention and are not intended to limit the invention in any way: All percentages, unless indicated otherwise, are intended to be percentages by weight.

All numerical ranges in this specification and claims are intended to be modified by the term about.

Finally, where the term comprising is used in the specification or claims, it is not intended to exclude any terms, steps or features not specifically recited.

Advantageously, the bottle of the invention can be made on a wheel machine, i.e., a high speed production blow molding apparatus, or a Uniloy brand or other shuttle machine. A "wheel" machine rotates and clamps around a continuously extruded comparison. Bottles are ejected after forming.

It will be apparent that the pouring fitment and container of the invention may be used for liquid laundry and other detergents, fabric softeners and many other types of liquid household and other products.

As used herein, "handle" refers to a structure for holding the bottle where there is a "hole" through which the human hand can extend. A gripping feature is a pair of indentations facilitating the holding of the bottle by a human hand, but which does not include a "hole."

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

What is claimed is:

1. A bottle fabricated from at least three layers, comprising a middle layer, an outer layer and an inner layer wherein the outer and inner layers are a metallocene polyethylene polymer, and the middle layer comprises virgin high density polyethylene, regrind and post-consumer recycled resin, said bottle having at least 10% transmittance of light in the visible spectrum.

2. A bottle according to claim 1, having at least 15% transmittance of light in the visible spectrum.

3. A bottle according to claim 1, having at least 20% transmittance of light in the visible spectrum.

4. A bottle according to claim 1, having at least 25% transmittance of light in the visible spectrum.

5. A bottle according to claim 1, wherein said middle layer is comprised of at least 25% recycled resin.

6. A bottle according to claim 1, wherein said outer and/or inner layer is comprised of a blend of metallocene polyethylene and high density polyethylene.

7. A bottle according to claim 1, wherein said outer and inner layer each comprise 5–15% of the total thickness of the bottle wall.

8. A bottle comprising a downwardly extending body fabricated from at least three layers, comprising an external and internal layer wherein the external and internal layer are a metallocene polyethylene polymer, a middle layer between the external and internal layers and comprising recycled resin, virgin high density polyethylene and regrind, and wherein said bottle further comprises a finish having an annular mouth, said body extending axially downwardly along a vertical axis from said finish to a base; said body including a shoulder extending outwardly and downwardly below said finish, said bottle having at least 10% transmittance of light in the visible spectrum.

9. A bottle according to claim 8, having at least 15% transmittance of light in the visible spectrum.

10. A bottle according to claim 8, having at least 20% transmittance of light in the visible spectrum.

11. A bottle according to claim 8, having at least 25% transmittance of light in the visible spectrum.

12. A bottle according to claim 1 wherein the middle layer has a thickness of about 80% of all layers of a wall of the bottle.

13. A bottle according to claim 1 wherein the middle layer comprises about 25% post-consumer recycled resin, about 25% virgin high density polyethylene and about 50% regrind.

14. A bottle according to claim 1 wherein a wall of the bottle fabricated from the at least three layers has a thickness of about 1 mm.

15. A bottle according to claim 8 wherein the middle layer has a thickness of about 80% of all layers of a wall of the bottle.

16. A bottle according to claim 8 the middle layer comprises about 25% post-consumer recycled resin, about 25% virgin high density polyethylene and about 50% regrind.

17. A bottle according to claim 8 wherein a wall of the bottle fabricated from the at least three layers has a thickness of about 1 mm.

* * * * *